US005931096A

United States Patent [19]

Detmers et al.

[11] Patent Number: 5,931,096

[45] Date of Patent: Aug. 3, 1999

[54] CLEANING CLOTH FOR A CLEANING DEVICE ON A PRINTING MACHINE

[75] Inventors: Andreas Detmers, Mauer; Mathias Müller, Wiesloch-Baiertal, both of Germany

[73] Assignee: Heidelberger Druckmaschinen AG, Heidelberg, Germany

[21] Appl. No.: 08/891,310

[22] Filed: Jul. 10, 1997

[30] Foreign Application Priority Data

Jul. 10, 1996 [DE] Germany ..... 196 27 748

[51] Int. Cl.[6] ..... B41F 35/00

[52] U.S. Cl. ..... 101/425; 101/424

[58] Field of Search ..... 101/425, 424, 101/423, 483; 15/104.93

[56] References Cited

U.S. PATENT DOCUMENTS

| | | | |
|---|---|---|---|
| 3,801,428 | 4/1974 | Striegler et al. | 161/169 |
| 4,428,777 | 1/1984 | Muller | 134/6 |
| 4,465,612 | 8/1984 | Altenschopfer et al. | 134/42 |
| 4,525,411 | 6/1985 | Schmidt | 428/198 |
| 4,686,132 | 8/1987 | Sumii et al. | 15/104.93 |
| 4,931,201 | 6/1990 | Julemont | 252/91 |
| 4,968,381 | 11/1990 | Prigge et al. | 252/79.1 |
| 5,105,740 | 4/1992 | Loos et al. | 101/425 |
| 5,477,406 | 12/1995 | Sshaeffer et al. | 360/130.33 |
| 5,537,924 | 7/1996 | Krause | 101/423 |
| 5,705,447 | 1/1998 | Kubo | 101/425 |

FOREIGN PATENT DOCUMENTS

| | | |
|---|---|---|
| 86 25 633 | 1/1987 | Germany . |
| 39 07 611 C2 | 9/1990 | Germany . |
| 39 09 119 A1 | 9/1990 | Germany . |
| 41 05 674 A1 | 8/1992 | Germany . |
| 1 458 630 | 12/1976 | United Kingdom . |

*Primary Examiner*—Edgar Burr
*Assistant Examiner*—Anthony H. Nguyen
*Attorney, Agent, or Firm*—Herbert L. Lerner; Laurence A. Greenberg

[57] ABSTRACT

In a cleaning device on a printing press for cleaning outer cylindrical surfaces of cylinders and rollers, there is provided a cleaning cloth unwindable from a supply roll and guidable via a pressure bar to a drivable soiled-cloth take-up roll, the cleaning cloth being pressable during the cleaning operation by the pressure bar against the outer cylindrical surface to be cleaned, the cleaning cloth being formed with a fleece material of stiffened and constrained microfibers having a large surface, high wear resistance, constant density distribution, high absorbability, and low lint formation.

3 Claims, 1 Drawing Sheet

CLEANING CLOTH FOR A CLEANING DEVICE ON A PRINTING MACHINE

BACKGROUND OF THE INVENTION

1. Field of the Invention

The invention relates to a cleaning cloth for a cleaning device on a printing machine and, more particularly, to a cleaning cloth for cleaning outer cylindrical or casing surfaces of cylinders and rollers which is unwindable from a supply roll via a pressure bar and guidable to a drivable soiled cloth roll, the cleaning cloth being pressable during the cleaning operation by the pressure bar against the outer cylindrical surface to be cleaned.

2. Description of the Related Art

U.S. Pat. No. 5,105,740 discloses a cleaning device which advances the cleaning cloth a given length for each cleaning operation. Depending upon the extent to which the outer cylindrical surface is soiled, the cleaning cloth may, for example, be moistened with an ink dissolving medium in order to improve the cleaning effect. The cleaning cloth used in this heretofore known cleaning device is formed of a textile web having good absorbability, and removes the dirt by wiping action from the outer cylindrical surface to be washed. The wiping action is effected by having the outer cylindrical surface of a cylinder or a roller to be washed move against the cleaning cloth, for example, during the operation of the printing machine. In this regard, the cleaning cloth it pressed elastically against the outer cylindrical surface over the length thereof, yet it is not possible to avoid, for example, tightly-adhering dried ink residues from forming streaks on outer cylindrical surfaces to be cleaned.

It is accordingly an object of the invention to provide a cleaning cloth in a cleaning device on a printing machine which markedly improves the cleaning action and which reliably removes ink and silicone residues, respectively, from the outer cylindrical surface of a cylinder or roller to be cleaned.

SUMMARY OF THE INVENTION

With the foregoing and other objects in view, there is provided, in accordance with the invention, in a cleaning device on a printing press for cleaning outer cylindrical surfaces of cylinders and rollers, a cleaning cloth unwindable from a supply roll and guidable via a pressure bar to a drivable soiled-cloth take-up roll, the cleaning cloth being pressable during the cleaning operation by the pressure bar against the outer cylindrical surface to be cleaned, the cleaning cloth comprising a fleece material of stiffened and constrained microfibers having a large surface, high wear resistance, constant density distribution, high absorbability, and low lint formation.

In accordance with another feature of the invention, the fleece material is calendered and has an irregular surface structure.

In accordance with a further feature of the invention, the fleece material is calendered and has a surface structure having no effect upon washing and printing results.

In accordance with an added feature of the invention, the fleece material is formed in a direction transverse to the cleaning and moving directions of the cleaning cloth.

In accordance with a concomitant feature of the invention, the fleece material is impregnated with a tenside.

Other features which are considered as characteristic for the invention are set forth in the appended claims.

Although the invention is illustrated and described herein as embodied in cleaning cloth for a cleaning device on a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
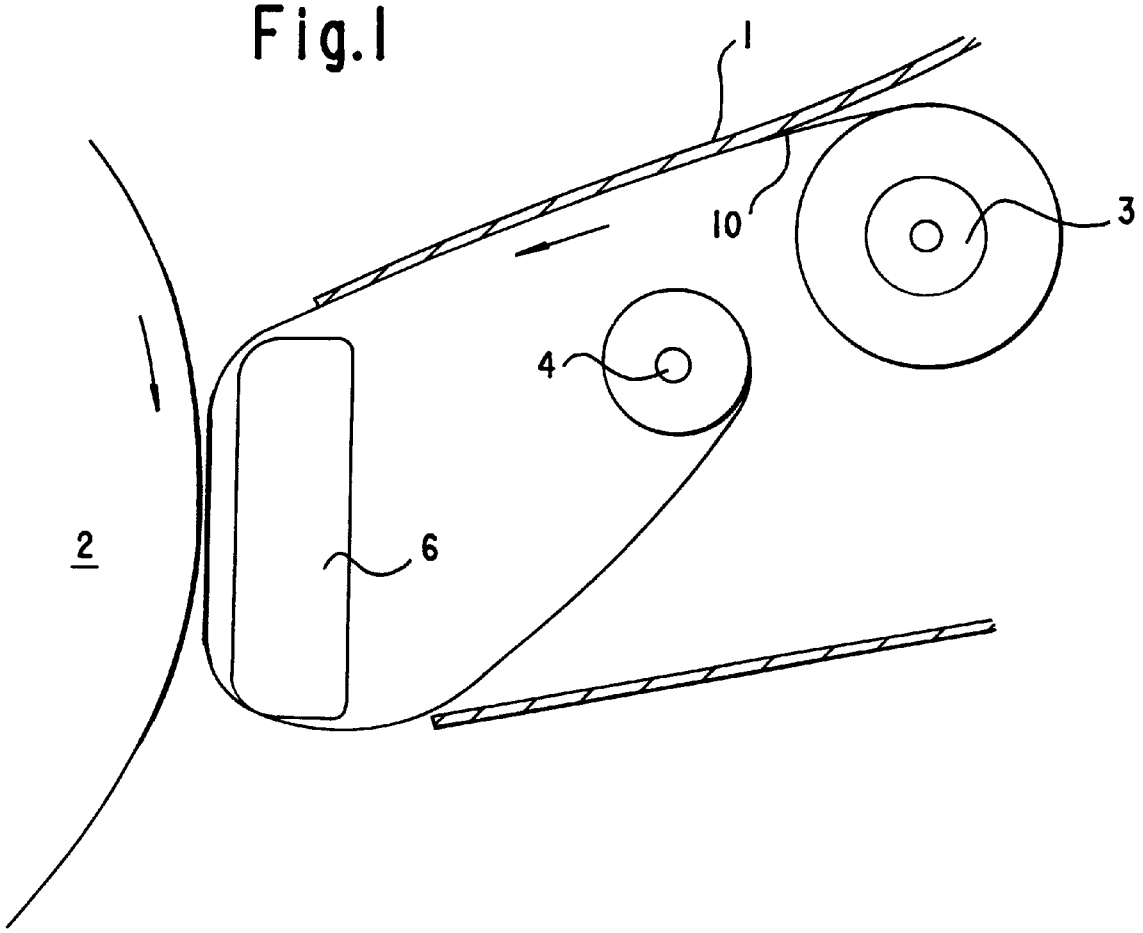
FIG. 1 is a fragmentary diagrammatic view of a cleaning device on a printing machine for cleaning the outer cylindrical surface of cylinders and rollers of the printing machine.

Referring now to the drawings and, first, particularly to FIG. 1 thereof, there is shown therein a cleaning device 1 similar to that which is disclosed in the aforementioned U.S. Pat. No. 5,105,740. The cleaning device 1 is disposed adjacent to a printing machine cylinder, such as a blanket cylinder 2. A supply roll 3 is provided for a cleaning cloth 10 which, when soiled, is wound on a soiled or dirty-cloth take-up roll 4. A pressure-applying device or bar 6 presses the cleaning cloth 10 against the outer cylindrical surface of the blanket cylinder 2. Specific mechanisms for advancing and winding up the cleaning cloth are shown and described for example, in the aforementioned U.S. Pat. No. 5,105,740, and do not form any part of the invention of the instant application.

Figure 2:
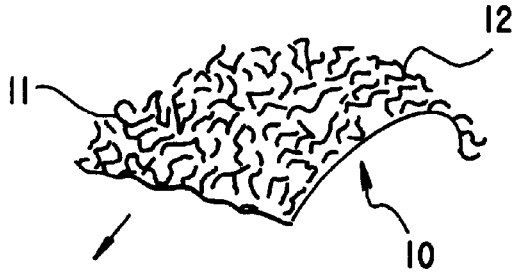
FIG. 2 is an enlarged fragmentary perspective view of a cleaning cloth according to the invention which is used in the device of FIG. 1 for cleaning the outer cylindrical surface of a cylinder or roller.

As shown in FIG. 2, the cleaning cloth 10 is formed of fleece material 11 having stiffened and constrained microfibers 12 with a large surface. The fleece material 11 is of high wear resistance, constant density distribution, high absorbability, and is subject to low lint formation. The fleece material is calendered and has an irregular surface structure which has no effect upon any washing or printing results on the cylinder which is to be cleaned. The fleece material 11 is produced in a direction transverse to the cleaning and moving directions of the printing cloth 10 represented by the arrow in FIG. 2. The fleece material 11 is impregnated with a tenside.

In the course of operation of the cleaning device 1 the fleece material 11 of the cleaning cloth 10 produces an aggressive wiping effect and, for example, by moistening with a suitable solvent, also removes firmly adhering ink residues. Should image formation be effected on a printing plate, for example, the fleece material 11 possesses a high absorbability for silicone residues and is capable of removing them completely from the outer cylindrical surface of a cylinder to be cleaned. Due to the high wearability, such a cleaning cloth of fleece material can be used many times after the cleaning, so that waste disposal costs are economized.

Fleece material which is calendered may be used, the surface structure of which produces a uniform wiping effect or action which has no effect upon the washing and printing results previously obtained on the outer cylindrical surface of the respective printing-machine cylinder. Circles, rods, rhombuses, triangles and forms with or without overlapping can be selected for the surface structure. The fleece material 11 used for the cleaning cloth 10 of the invention may, for example, be a microfiber sold under the trademark BELIMA X of the firm Freudenberg in Germany. The BELIMA X microfiber is a micro-fine layered fiber formed of two fiber components constructed in a special cross sectional shape. The cross sectional shape is composed of a core with extending arms forming a star shape. The regions between the arms are filled with wedge shaped sectors. The core and arms are formed of a hydrophilic fiber (water attracting fiber) and the wedge shaped sectors are formed of a lipophilic fiber (water repelling fiber).

The fleece material 11 is used in a manner that the direction in which it is manufactured extends transversely to the cleaning or moving direction of the unwinding or rewinding cleaning cloth 10. The microfibers are then capable of exerting an increased wiping action upon the outer cylindrical or casing surface of the respective cylinder or roller to be cleaned. The high absorbability for the waste or impurities to be removed is not impaired or jeopardized in any manner. The fleece material 11 may also be impregnated with a tenside. When impregnating, for example, 2 to 10 grams of solid component may be provided.

We claim:

1. In combination with a printing press, a cleaning device for cleaning outer cylindrical surfaces of cylinders and rollers, comprising:

a supply roll;

a pressure bar;

a drivable soiled-cloth take-up roll;

a cleaning cloth unwindable from said supply roll and guidable via said pressure bar to said drivable soiled-cloth take-up roll, said cleaning cloth being pressable during the cleaning operation by said pressure bar against the outer cylindrical surface to be cleaned, said cleaning cloth including a fleece material of microfibers having an irregular surface structure, a constant density distribution, and absorbs silicone residue; and said fleece material is calendered and produced in a direction transverse to the cleaning and moving directions of said cleaning cloth.

2. The cleaning cloth according to claim 1, wherein said fleece material is impregnated with a tenside.

3. The cleaning cloth according to claim 1, wherein said surface structure having no effect upon washing and printing results.

* * * * *